US006083064A

United States Patent [19]

Watanabe et al.

[11] Patent Number: 6,083,064

[45] Date of Patent: Jul. 4, 2000

[54] COOLING SYSTEM FOR OUTBOARD MOTOR

[75] Inventors: Takahide Watanabe; Masanori Takahashi; Hitoshi Watanabe, all of Hamamatsu, Japan

[73] Assignee: Sanshin Kogyo Kabushiki Kaisha, Hamamatsu, Japan

[21] Appl. No.: 09/130,143

[22] Filed: Aug. 6, 1998

[30] Foreign Application Priority Data

Aug. 8, 1997 [JP] Japan ..... 9-214707
Aug. 8, 1997 [JP] Japan ..... 9-214709

[51] Int. Cl.[7] ..... B63H 21/10

[52] U.S. Cl. ..... 440/88

[58] Field of Search ..... 440/88.89; 204/197; 123/41.15, 196 W, 41.01

[56] References Cited

U.S. PATENT DOCUMENTS 5,803,023 9/1998 Takahashi et al. ..... 440/88
5,921,829 7/1999 Iwata ..... 440/88

*Primary Examiner*—Jesus D. Sotelo
*Attorney, Agent, or Firm*—Knobbe, Martens, Olson & Bear LLP

[57] ABSTRACT

An outboard motor cooling system wherein the coolant is circulated through the various cooling jackets so that it first flows into proximity with at least a portion of the exhaust system cooling jacket and then into the cooling jackets of the main engine body that cool the cylinder bore and combustion chamber. Sacrificial anodes are positioned both in the main engine body cooling jacket and in the exhaust system cooling jacket. In addition, a temperature sensor is positioned in a low portion of the cooling jacket and where the water has passed through the exhaust cooling jacket and before it enters the main engine body cooling jacket so as to provide accurate temperature indication while protecting the temperature sensor from excess temperature conditions particularly after engine shut off.

21 Claims, 11 Drawing Sheets

COOLING SYSTEM FOR OUTBOARD MOTOR

BACKGROUND OF THE INVENTION

This invention relates to an outboard motor and more particularly to an improved cooling system for outboard motors.

As is well known, outboard motors normally have their engines cooled by a liquid cooling system that draws water from the body of water in which the watercraft is operating and which discharges it back to the body of water after it has passed through the various cooling jackets of the engine and its auxiliaries. In this way, the body of water acts a heat exchanger for the engine.

Although the principle is quite simple, in practice, there are several problems in connection with such arrangement. One of these is that the cooling system, in addition to cooling engine cylinder block and cylinder head, frequently is employed for cooling also a portion of the exhaust system. Thus, the path of coolant must be chosen so as to provide the desired degree of cooling for the various components, particularly considering significantly different temperature characteristics that may arise in the various components that are cooled.

Because of the fact that outboard motors are frequently utilized in marine environments, corrosion can be a significant problem. This, coupled with the use of dissimilar materials in the engine and its auxiliaries, can give rise to galvanic corrosion problems. Therefore, it has been the practice to employ sacrificial anodes in the engine for the protection against corrosion.

However, due to the dissimilar materials and dissimilar conditions, a single anode positioned in the engine cooling jacket may not be adequate to protect the entire engine and auxiliaries which are cooled.

It is, therefore, a principal object of this invention to provide an improved anodic protection system for an outboard motor and its associated components.

It is a further object of this invention to provide an outboard motor cooling system that employs a plurality of anodes, each positioned and constructed to protect a specific part of the engine.

In conjunction with certain engine controls and for various other purposes, it may also be desirable to incorporate a temperature sensor that senses temperature in the coolant system. It should be apparent from the foregoing description, however, the temperature in the cooling system can vary significantly and be quite high in some areas. Thus, the temperature sensor may experience wide ranges of temperatures and can, therefore, become damaged.

Also because the water may drain at least in part from the engine cooling jackets when the engine is stopped the sensor temperature may become elevated, there is a danger the sensor may be overheated from the residual engine heat.

It is, therefore, a further object of this invention to provide an improved temperature sensing arrangement for the cooling system of an outboard motor.

SUMMARY OF THE INVENTION

The features of this invention are adapted to be embodied in the cooling system of an outboard motor powered by a water-cooled internal combustion engine. The outboard motor includes a power head in which the engine is contained and which is surrounded by a protective cowling. A drive shaft housing and lower unit depend from the power head and contain a propulsion device for propelling an associated watercraft through a transmission for driving this propulsion device from the engine. The engine is provided with an exhaust system by which the exhaust gases are discharged from the engine to the atmosphere at least in part through the drive shaft housing and lower unit. The engine and the exhaust system are provided with a cooling system that includes a cooling jacket which extends around the basic engine and also around a portion of the exhaust system so both will be cooled. Coolant for circulation through these cooling jackets is drawn from the body of water in which the watercraft is operated and is discharged back to the body of water at least in part along with the exhaust gases.

In accordance with a first feature of the invention, a first sacrificial anode is positioned in the exhaust system cooling part while protecting it from corrosion. At least one second anode is positioned in the main engine body cooling jacket for protecting it from corrosion.

In accordance with another feature of the invention, a temperature sensor is employed. This temperature sensor is positioned in the discharge end of the exhaust cooling jacket and upstream of the engine cooling jacket so as to sense a temperature that is indicative of engine operating temperature but not at a point where the water has completely passed through the cooling jacket and is being discharged back to the body of water in which the watercraft is operating.

DETAILED DESCRIPTION OF THE PREFERRED EMBODIMENT

Figure 1:
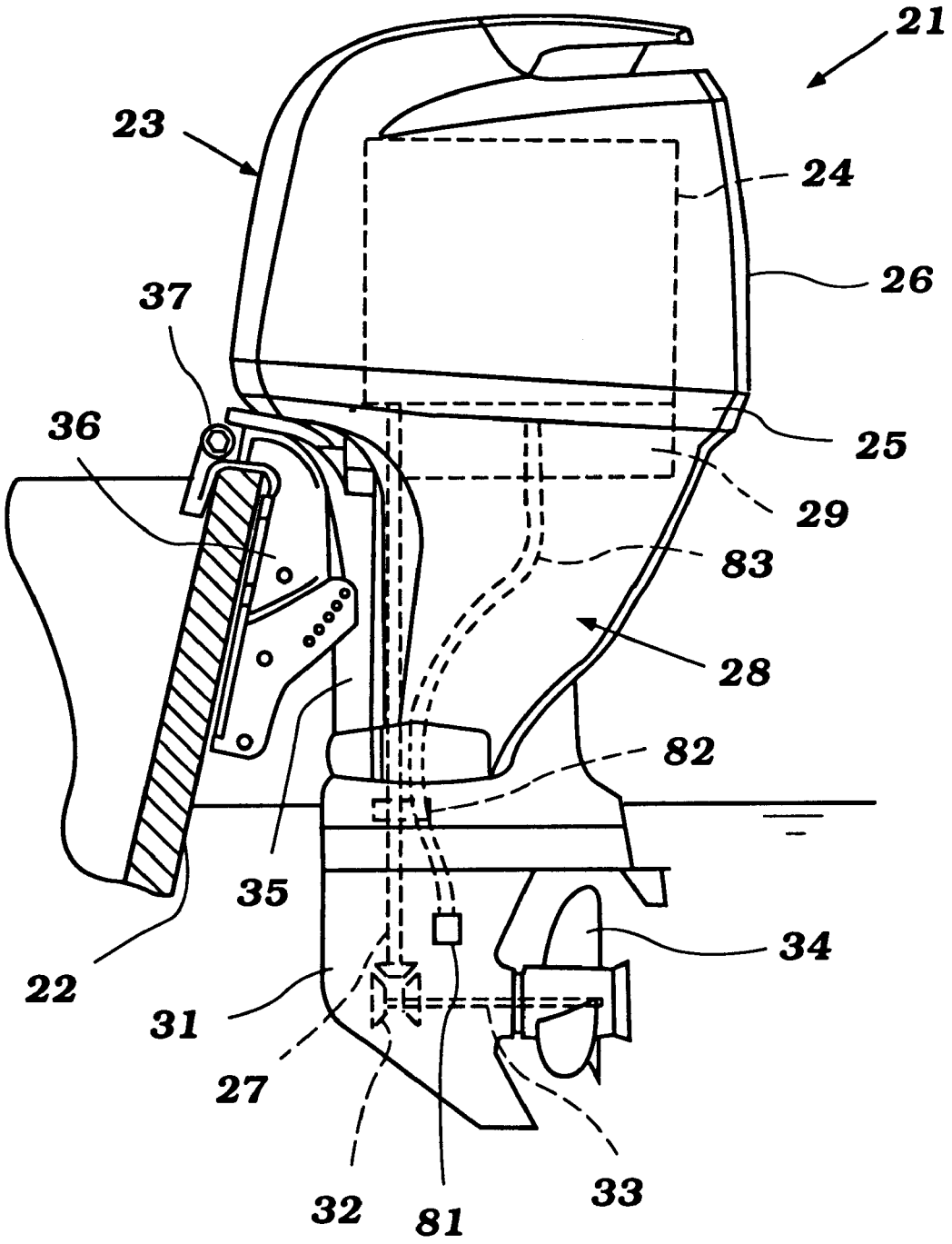
FIG. 1 is a side elevational view of an outboard motor shown attached to the transom of an associated watercraft, which is shown partially and in section.

Referring now in detail to the drawings and initially to FIG. 1, an outboard motor constructed in accordance with an embodiment of the invention is indicated generally by the reference numeral 21. In this Figure, the outboard motor 21 is shown attached to the transom 22 of an associated watercraft which is shown partially and in cross section.

The outboard motor 21 is comprised of a power head assembly 23 that consists primarily of a powering internal combustion engine, shown in phantom in this view and indicated by the reference numeral 24, and a surrounding protective cowling. This protective cowling includes a lower, tray member 25 and an upper, main cowling member 26 that is detachably connected to the tray member 25 in a suitable arrangement.

As will become apparent as the description proceeds, the engine 24 is mounted in the power head 23 so that its crankshaft (not shown in this figure but which will be described later) rotates about a vertically extending axis. This is typical with outboard motor practice and is done so as to facilitate the connection to a drive shaft 27 which depends into a drive shaft housing lower unit assembly, indicated generally by the reference numeral 28. An exhaust guide 29 and support plate is provided at the upper end of the drive shaft housing 28 and the engine 24 is mounted upon it.

In a lower unit portion 31 of the drive shaft housing and lower unit assembly 28, there is provided a conventional forward neutral reverse bevel gear transmission, indicated generally by the reference numeral 32. This transmission 32 is adapted to drive a propeller shaft 33 that is mounted in the lower unit 31 and to which a propeller 34 is attached. This forward neutral reverse transmission 32 permits selection of the drive of the propeller 34 in forward or reverse propulsion mode or in a neutral condition in which the propeller 34 is not driven.

The drive shaft housing lower unit assembly 28 has affixed to it a steering shaft which is not shown in this figure, but which is mounted for steering movement in a swivel bracket 35 in a manner that is well known in this art. The swivel bracket 35 is, in turn, connected to a clamping bracket 36 by means that include a pivot pin 37 for tilt and trim movement of the outboard motor 21 in a manner which is also well known in this art.

Further details of the construction of the outboard motor 21 except for the engine 24 and its cooling system are not believed necessary to permit those skilled in the art to practice the invention. For that reason, any components of the outboard motor 21 which have not been described or illustrated may be considered to be conventional or any known constructions may be employed to practice the invention.

The construction of the engine 24 will now be described by primary reference to FIGS. 2–4. The engine 24 is comprised of a body made up of three major components comprised of a cylinder block 37, a cylinder head assembly 38 and a crankcase member 39 which are connected together in any known manner.

Figure 3:
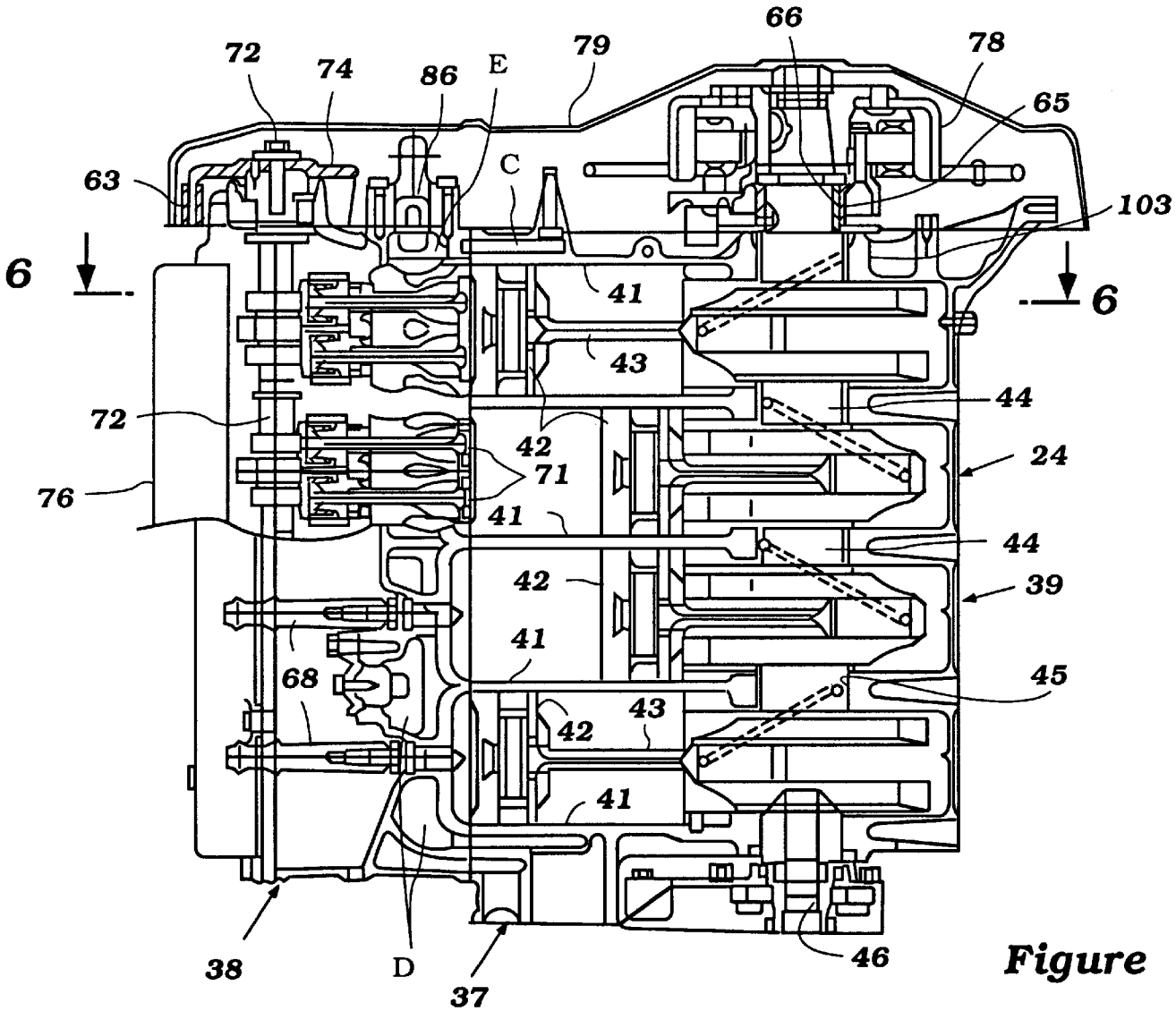
FIG. 3 is a view looking in the same direction as FIG. 2 showing only the engine and with portions of it broken away and shown in section.

As may be best seen in FIG. 3, the cylinder block 38 is formed with four vertically spaced, horizontally extending, cylinder bores 41. These cylinder bores 41 may be formed as liners or plated coatings in the cylinder block 37 which is formed primarily from a light alloy.

Pistons 42 are supported for reciprocation in the cylinder bores 41. These pistons 42 are connected by means of piston pins to the small ends of connecting rods 43. Each connecting rod 43 is journaled on a respective throw of the aforementioned crankshaft which appears in this and other figures and which is indicated generally by the reference numeral 44.

Although the invention is described in conjunction with a four-cylinder engine, it should be readily apparent to those skilled in the art how the invention can be employed with engines having other numbers of cylinders and also how the invention can be employed with engines in which the cylinders are disposed at an angle to each other such as with V-type engines.

The crankshaft 44 is journaled within a crankcase chamber that is formed by the cylinder block 37 and the crankcase member 39. This journalling is accomplished by means of bearing surfaces 45 which may be formed integrally with the crankcase member 39 and which cooperate with like bearing surfaces formed in the cylinder block 37. Of course, other arrangements are possible for the journalling of the crankshaft 44, as will become readily apparent to those skilled in the art.

As may be seen in FIG. 3, the lower end of the crankshaft 44 is provided with a splined opening 46 so as to receive the upper end of the drive shaft 27.

Figure 6:
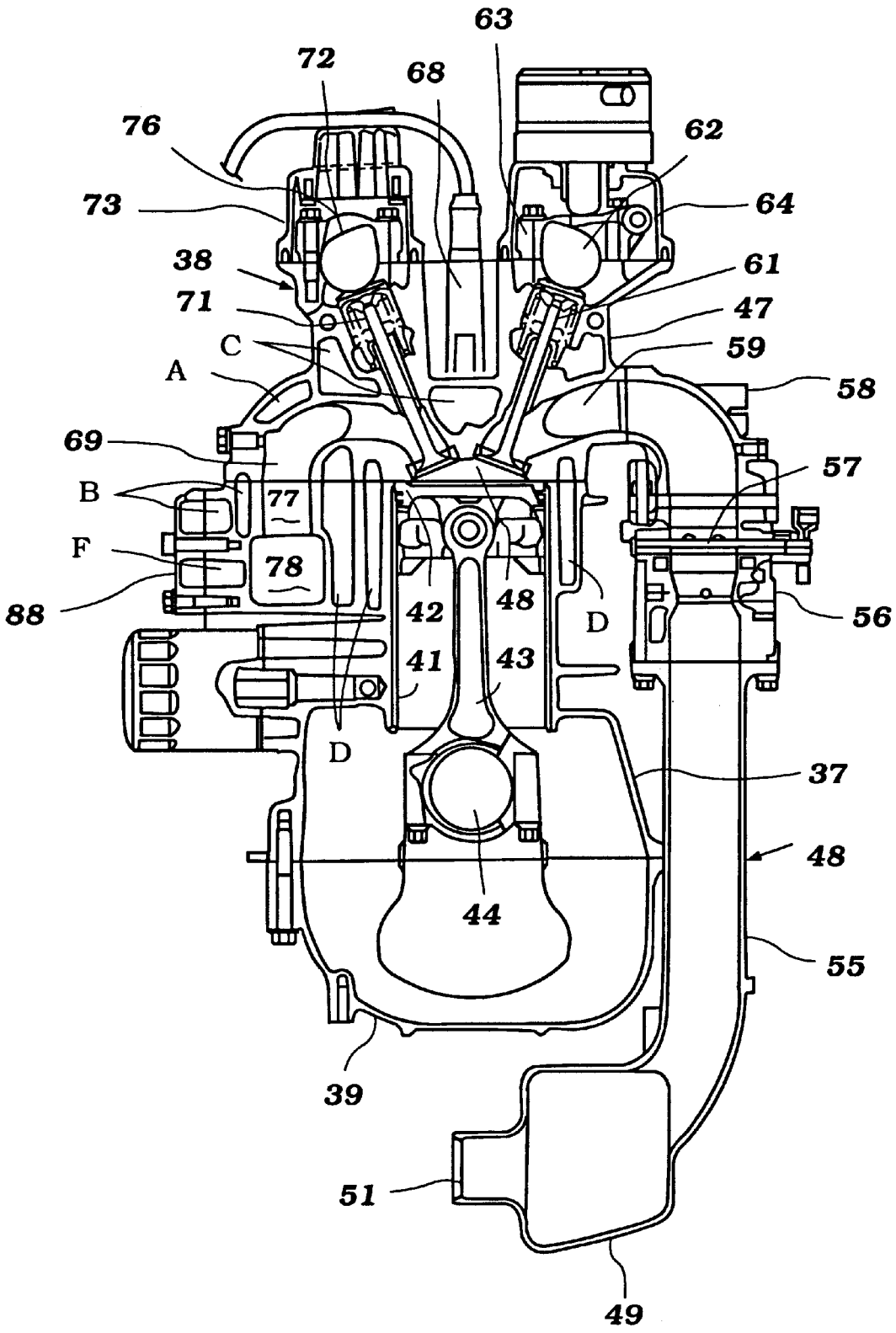
FIG. 6 is a cross-sectional view taken along the line 6—6 of FIG. 3.

Referring now primarily to FIGS. 3 and 6, it will be seen that the cylinder head assembly 38 is formed by a main cylinder head member 47 that has individual recesses 48 formed in its lower surface which cooperate with the cylinder bores 41 and pistons 42 so as to form the individual combustion chamber to the engine.

An intake charge is delivered to these combustion chambers by an induction system that is indicated generally by the reference numeral 48. This induction system, in the illustrated embodiment, is comprised of an air inlet and silencing device 49 mounted adjacent the forward end of the forwardmost surface of the crankcase member 39. An air inlet opening 51 permits air to be drawn into this silencing device from within the protective cowling.

Air is delivered to the interior of the protective cowling by means of a rearwardly facing air inlet opening 52 that is formed in the top of the rear portion of the main cowling member 26. This permits air to be drawn into a chamber 53 for introduction to the interior of the protective cowling through a pair of transversely spaced apart, upwardly extending inlet openings 54. This configuration facilitates the removal or separation of water from the inducted air.

The air collected in the air inlet device 49 is then delivered through a plurality of runner sections 55 to throttle body assemblies 56 in which flow controlling throttle valves 57 are positioned. These throttle valves 57 are operated by a suitable linkage system so as to control the speed of the engine 24 in a manner well known in this art.

The throttle bodies 56 communicate at their downstream ends with an intake manifold 58 which, in turn, forms a portion of the cylinder head assembly 38 and delivers the air charge to intake passages 59 formed in the main cylinder head member 47.

These intake passages 59 terminate at valve seats which are valved by poppet type intake valves 61. In the illustrated embodiment, there are provided two intake valve seats and two intake valve 61 for each cylinder bore 41. Obviously, other types and numbers of valve arrangements may be employed.

The intake valve 61 are urged to their closed positions by means of a suitable spring and keeper arrangement. An intake camshaft 62 is journaled in the cylinder head assembly 38 by means that include bearing caps 63. The intake camshaft 62 has cam lobes that open the intake valves 61 in a manner well known in the art. A cam cover 64 also forms a portion of the cylinder head assembly 38 and encloses the cam chamber in which the intake camshaft 62 rotates.

Figure 4:
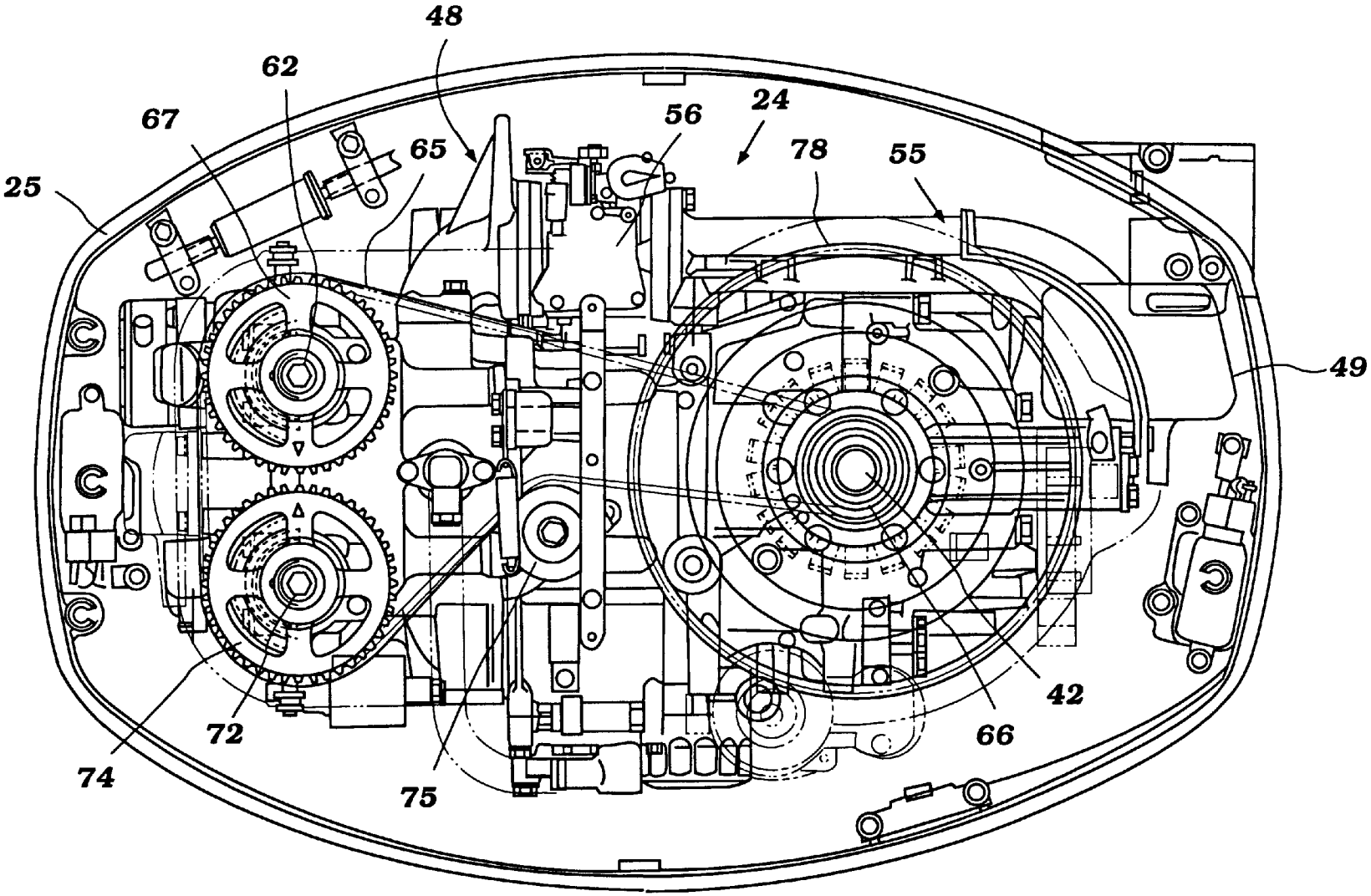
FIG. 4 is a top plan view of the power head with the main cowling and engine cover removed to show more clearly the structure of the engine.
Figure 5:
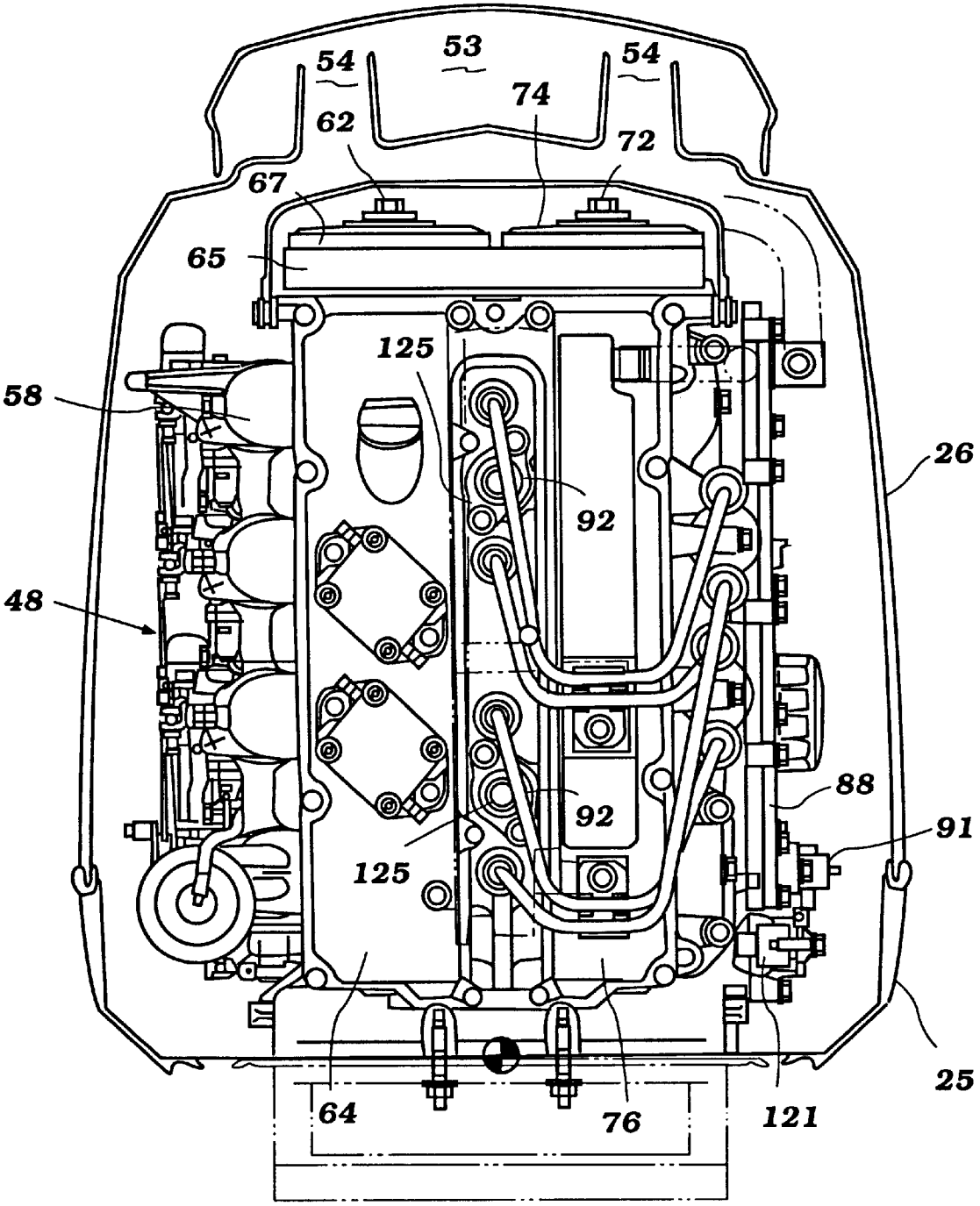
FIG. 5 is a rear elevational view of the power head showing the protective cowling broken away.

As best seen in FIG. 4, the intake camshaft 62 is driven at one-half crankshaft speed by means of a drive that includes a flexible transmitter such as a toothed belt 65. This belt is driven by a driving sprocket 66 that is fixed to the crankshaft 42 near its upper end. This belt, in turn, drives a driven sprocket 67 that is fixed to the upper end of the intake camshaft 62. The remainder of the cam drive will be described later.

Fuel is supplied to the combustion chambers of the engine through a suitable fuel charging system. This may be comprised of either carburetors, which can be formed as a part of the throttle bodies 56 or by means of fuel injectors. The fuel injectors may be manifold injectors that inject fuel into the induction system 48 at a suitable location. Alternatively, direct cylinder fuel injection may be employed. Since the method of fuel charge forming forms no part of the invention, it has not been illustrated nor is further description believed to be necessary to permit those skilled in the art to practice the invention.

Spark plugs 68 are mounted in the cylinder head assembly 38 and have their spark gaps extending into the combustion chamber recesses 48 of the cylinder head member 47. These spark plugs 68 are fired by a suitable ignition system.

The charge which is ignited by the spark plugs 68 will burn and expand to drive the pistons 42 downwardly in the cylinder bores 41. This motion is then transmitted, as aforenoted, through the connecting rods 43 to the crankshaft 44 to drive it.

The burnt charge is discharged from the combustion chambers through an exhaust system which includes cylinder head exhaust passages 69 which are formed in the cylinder head member 47 on the side opposite the intake passages 59. Like the induction system, the exhaust system may employ two valves per cylinder that valve the valve seats formed at the cylinder head recessed portion 48 of the intake passages 69. These exhaust valves are indicated by the reference numeral 71 and are urged to their closed positions in any suitable manner.

An exhaust cam shaft 72 is journaled in the cylinder head assembly 38 in a suitable manner which may include bearing cap 73. Like the intake camshaft 62, the exhaust camshaft 72 extends through an upper wall of the cylinder head assembly and has a driving sprocket 74 affixed to this end. The timing belt 65 also is entrained around this sprocket 74 and drives it at one-half crankshaft speed.

The return flight of the driving belt 65 is entrained around an idler sprocket 75 that is mounted on the upper side of the cylinder block 37 and which may be adjustable to tension the drive belt 65. This completes the description of the operation of the camshaft driving mechanism.

Like the intake camshaft 62, the exhaust camshaft 72 is enclosed by a cam cover 76 that is affixed to the main cylinder head member 47 in any known manner.

The exhaust passages 69 terminate in a forwardly facing surface of the cylinder head member 47 that is spaced transversely outwardly from the cylinder bores 41. This terminal ends of the exhaust passages 69 communicates with inlet runners 77 of an exhaust manifold that is formed in the cylinder block 37. This exhaust manifold includes a vertically extending collector section 78.

The lower end of this collector section 78 communicates with an exhaust passage formed in the exhaust guide plate 29. A suitable exhaust system is provided in the drive shaft housing and lower unit 28 for discharging these exhaust gases to the atmosphere. This exhaust system may include, as is typical with outboard motor practice, a high-speed underwater exhaust gas discharge and a low speed above the water exhaust gas discharge.

Figure 2:
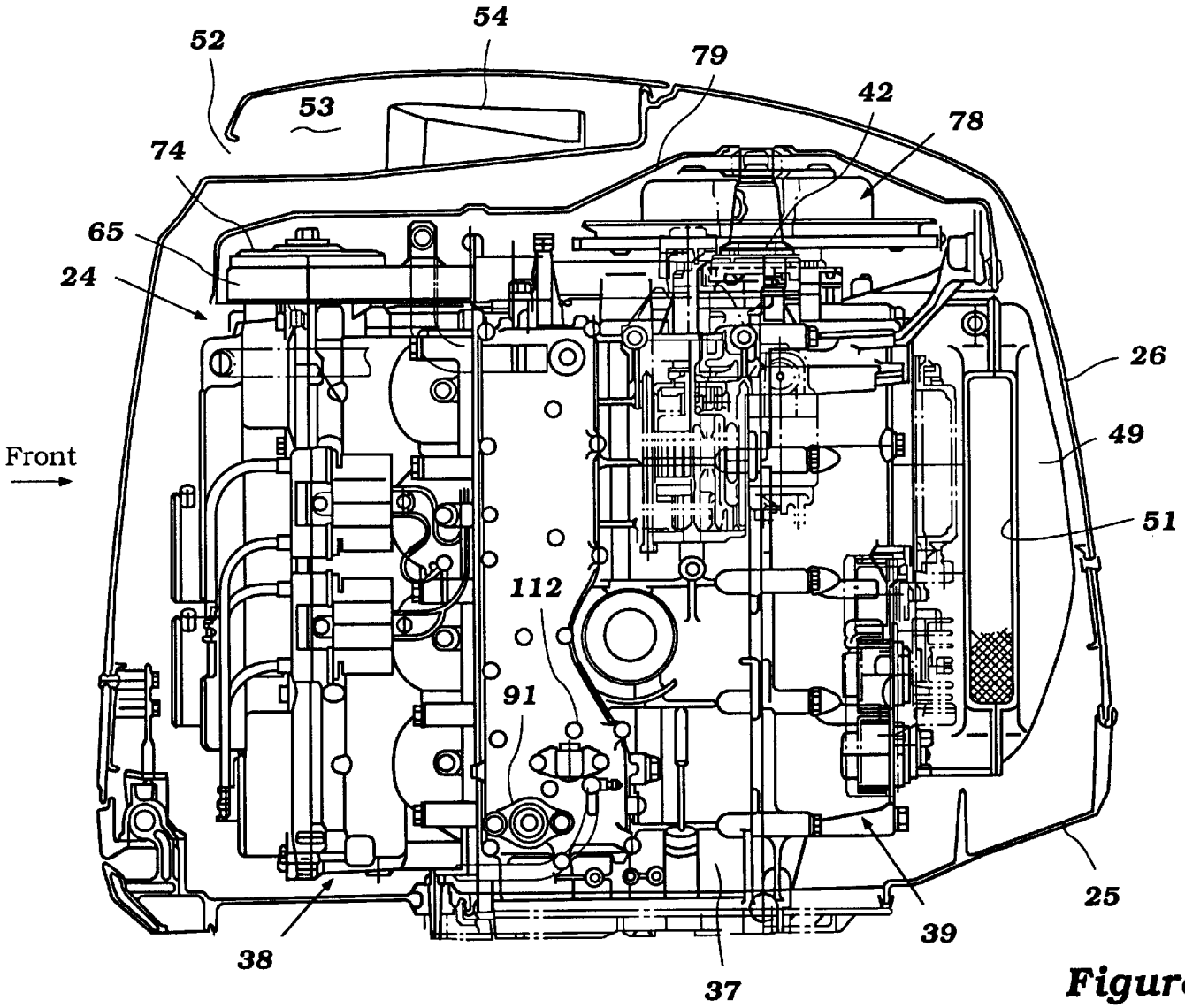
FIG. 2 is an enlarged side elevational view of the power head, looking in the direction opposite to that of FIG. 1 and with the protecting cowling shown in cross section to illustrate the external configuration of the engine.

As may be best seen in FIGS. 2–4, a flywheel magneto assembly, indicated generally by the reference numeral 78, is affixed to the upper end of the crankshaft 42 at a point above the timing drive belt 65 for the intake and exhaust camshafts 62 and 72. A starter motor (not shown) may be associated with the flywheel for starting of the engine. This assembly including the timing drive is covered by an engine cover plate 79 that is affixed to the upper side of the engine in any suitable manner.

The construction of the engine 24 as thus far described may be considered to be conventional. That is, the invention deals primarily with the cooling system and the way the liquid coolant flows through the various cooling jackets of the engine and is returned to the body of water in which the watercraft operates. Therefore, the foregoing description is merely to permit those skilled in the art to understand the environment in which the invention is utilized.

The cooling system will now be described in more detail starting by particular reference to FIG. 1, which merely shows the way the water is picked up and pumped through the engine cooling jackets which will be described shortly by reference to FIGS. 3–15.

Referring first to FIG. 1, it should be seen that the lower unit portion 31 is formed with a water inlet opening 81 that is disposed so that it will be under the level of water under all running conditions of the watercraft. As is typical with outboard motor practice, water is drawn through the inlet opening 81 by a water pump 82. The water pump 82 is driven off of the lower end of the drive shaft 27 at a point where the drive shaft housing and lower unit portions meet.

Figure 7:
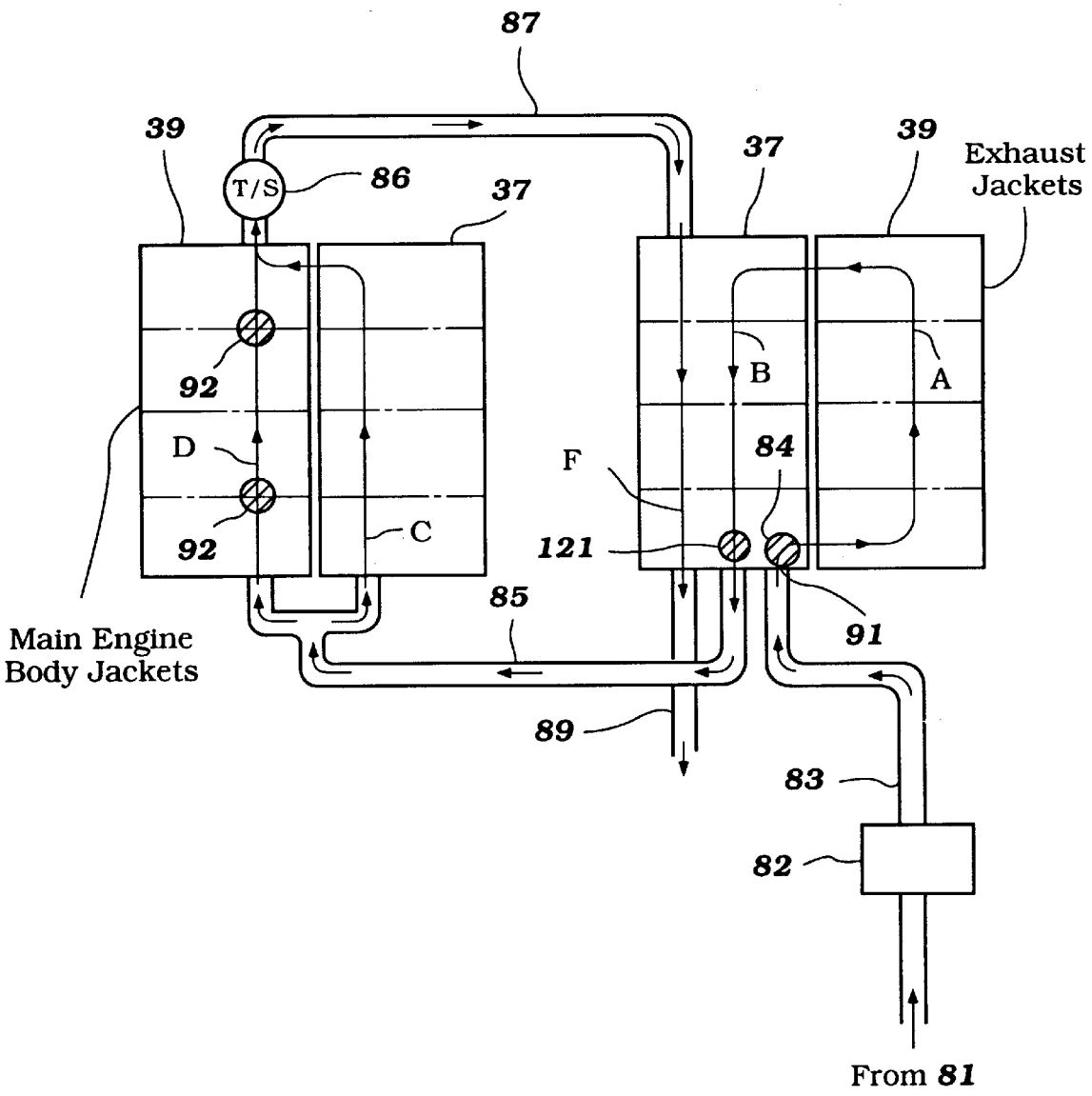
FIG. 7 is a schematic view showing the path of coolant through the engine cooling jacket components.

The coolant is then pumped upwardly through a conduit 83 which also appears schematically in FIG. 7. This cooling water is then delivered to an inlet pocket 84 (FIGS. 7 and 9) that is formed in the lower end of the cylinder block and which communicates with a through passage to the cylinder head 39 and specifically a cylinder head coolant jacket and flow path, indicated by the reference character A. The path A extends along the exhaust side of the cylinder head assembly 38 and appears in its actual construction in FIG. 6.

This coolant path A is disposed in proximity to the point where the exhaust gases are first exiting the combustion chambers and hence, are at their highest temperature. This flow path A also appears in FIG. 9.

From this point, the coolant then transferred over back into the cylinder block 37 through a suitable passage formed at the interface between the cylinder head and the cylinder block so as to flow downwardly in a direction indicated by the arrow B through like designated cooling jacket paths B formed in the cylinder block adjacent the exhaust manifold runner sections 77 and collector section 78 formed therein. Again, this is an area where the exhaust gases are most highly heated.

The coolant then flows downwardly through these jacket portions or passages and exits through the lower face of the cylinder block 37 on the exhaust side where it communicates with passages, indicated schematically at 85 in FIG. 7, so as to flow back to the lower side of the main engine body cooling jackets formed in both the cylinder block 37 and the cylinder head 39 as seen in FIG. 7.

The coolant then flows upwardly through a flow paths and cooling jacket portion C formed in the cylinder head. In addition, this water flows upwardly through cooling jacket portions D formed on both sides of the cylinder block around the cylinder bores 41 and through to the upper phases face thereof wherein they terminate in a pocket E in the cylinder head shown in FIG. 3.

A thermostat, indicated generally by the reference numeral 86, is provided in this pocket E. This thermostat 86 controls the flow through a return passage, indicated schematically at 87 in FIG. 7 which then communicates with a downwardly directed exhaust side cooling jacket portion F formed in the cylinder block.

Figure 9:
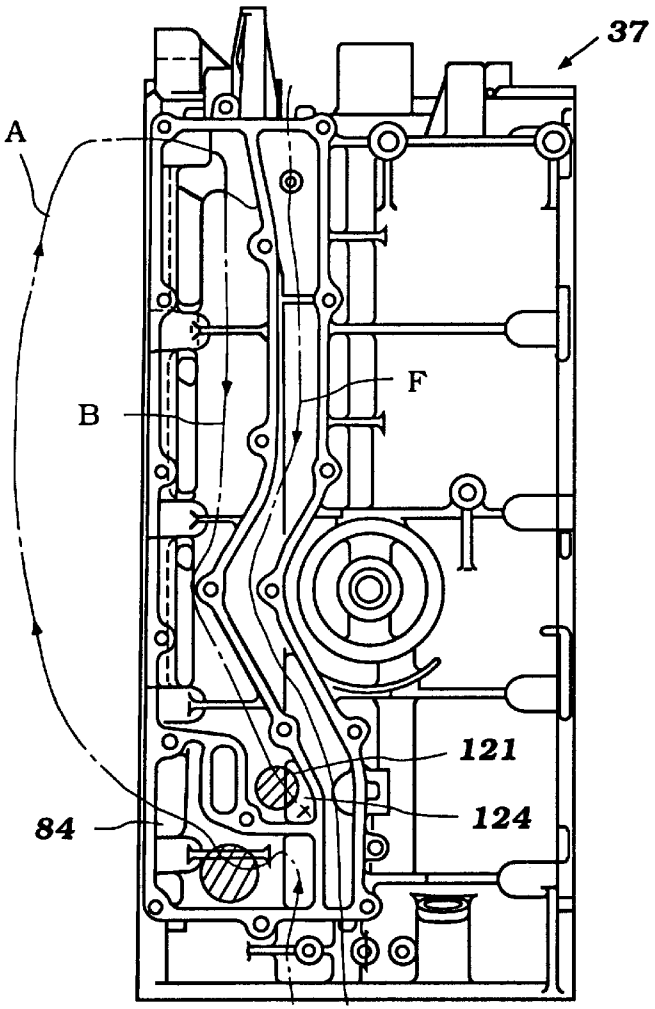
FIG. 9 is a view looking in the direction of the arrow 9 in FIG. 8 with the cover plate for the exhaust manifold cooling jacket removed.
Figure 8:
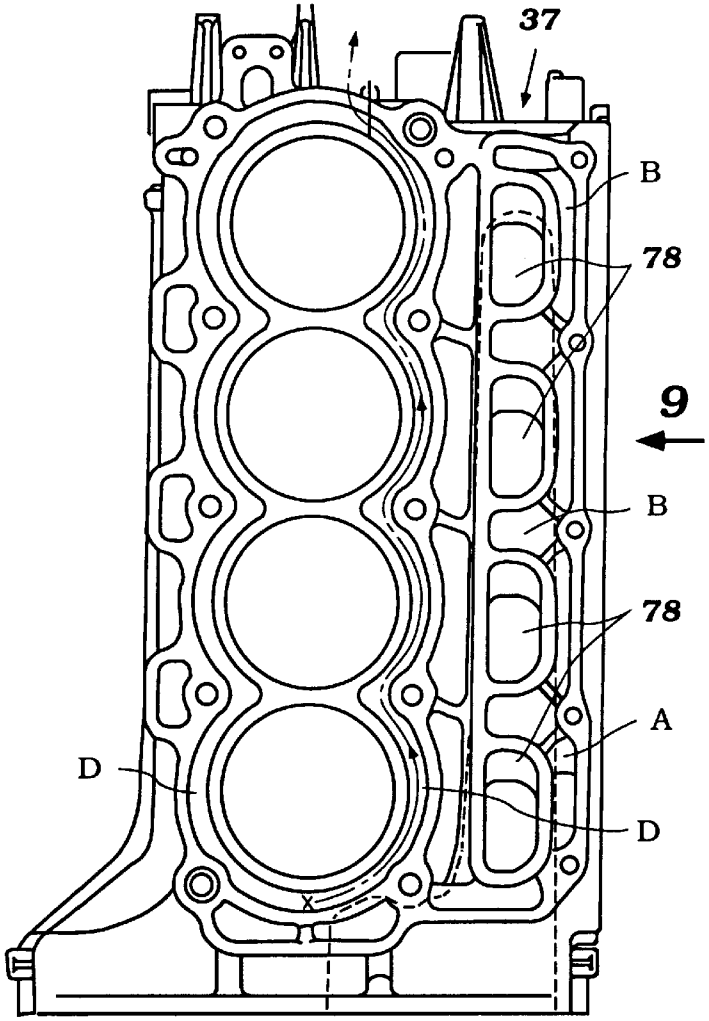
FIG. 8 is a top plan view of the cylinder block with the cylinder head and pistons removed so as to more clearly show the actual coolant flow through the engine.

It should be noted as best seen in FIGS. 6 and 9 that the cooling jacket paths B and F formed on the side of the cylinder block 47 adjacent the exhaust manifold portions 77 and 78 are actually open through the outer side of the cylinder block 47. A cover plate 88 is affixed across the open ends thereof so as to close this flow path so as to direct the water in the desired path.

This water is then discharged back to the body of water in which the watercraft is operating through a return, indicated schematically at 89 in FIG. 7. Some of this cooling water may be mixed with the exhaust gasses to cool them to assist in the exhaust silencing.

As seen in FIGS. 2, 7 and 9, at the point where the cooling water first enters the cylinder block 37 from the conduit 83 and is transferred immediately through the cooling jacket portion 84, there is provided a sacrificial anode 91 for corrosion protection at the point where the water will first come into contact with the exhaust manifold cooling jacket portion A. Thus, the exhaust manifold, which may be formed in part from a cover plate that may be formed from a material other than that of the cylinder block, i.e., the plate 88, will be subject to galvanic protection.

Figure 10:
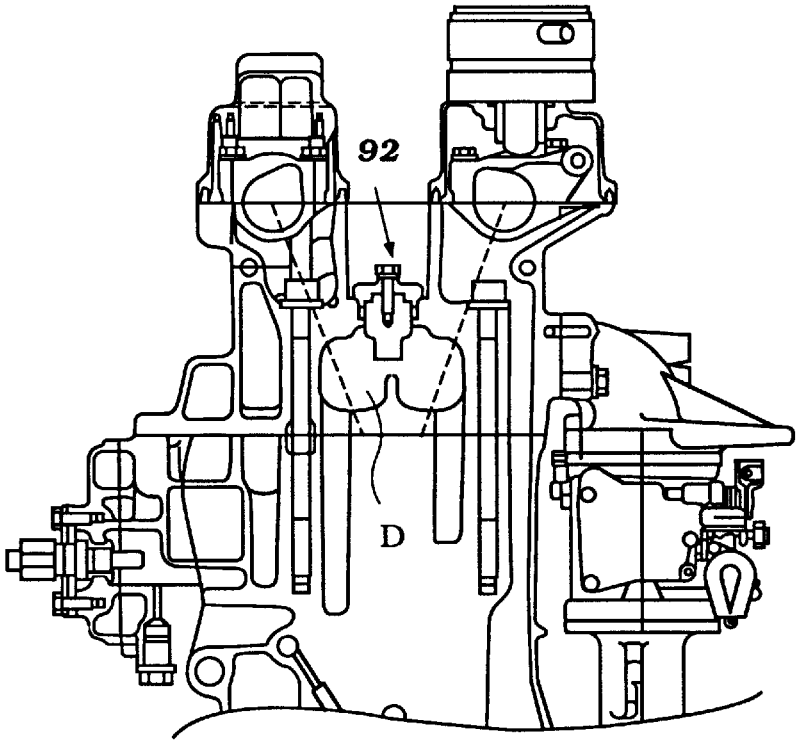
FIG. 10 is a partial cross-sectional view of the cylinder head taken along a plane parallel to the plane of FIG. 6 but showing the anodes for the cylinder head cooling jacket.
Figure 11:
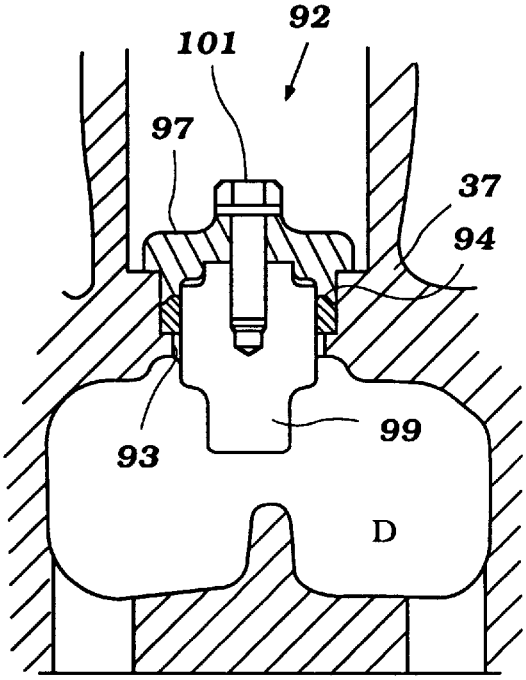
FIG. 11 is an enlarged cross-sectional view showing the actual anode construction in FIG. 10.
Figure 12:
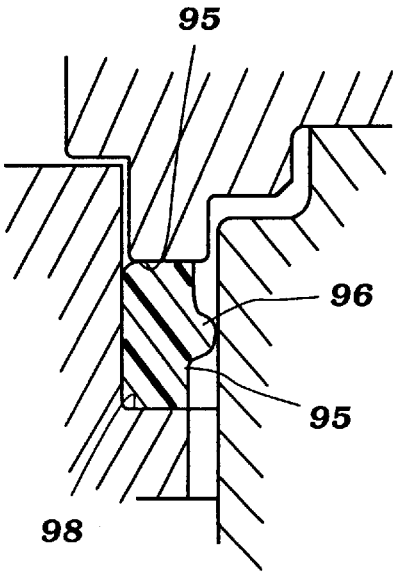
FIG. 12 is a further enlarged cross-sectional view showing the sealing arrangement for the anode.

The construction of the anode 91 may be the same as those associated with the cylinder head 39 and which will now be described by primary reference to FIGS. 10–12 wherein a first embodiment thereof is depicted.

These corrosion protection anodes are indicated generally by the reference numeral 92 and are adapted to be mounted in clean-out openings 93 formed in the cylinder head 39 in communication with its cooling jacket portions D. The cylinder head is formed with a counter bored opening 94 above the clean-out opening 93 and which receives a seal, indicated generally by the reference numeral 95. This seal 95 has a generally cylindrical body portion 95 from which a rib 96 extends.

The anode member 92 includes a mounting part 97 that has a downwardly extending portion 98 that engages the seal 95 and urges it into engagement with a shoulder 98 formed at the end of the counter bore 94. This causes the rib 96 to move into tight sealing engagement with an anode element 99 that is fixed to the closure member 97 by means of a threaded fastener 101.

Thus, a watertight seal is provided on one which permits the anode assembly 92 to be replaced when the highly reactive anode element 99 corrodes away. Thus, good servicing is easily assured and good protection is provided for the components of the engine which define the various cooling jackets described.

The anode members 92 are fixed in place in any suitable manner. For example they may be retained in the same manner as with the temperature sensor to be described shortly. Therefore where the attachment appears in the figures the numerals used to describe that construction have been employed.

Figure 13:
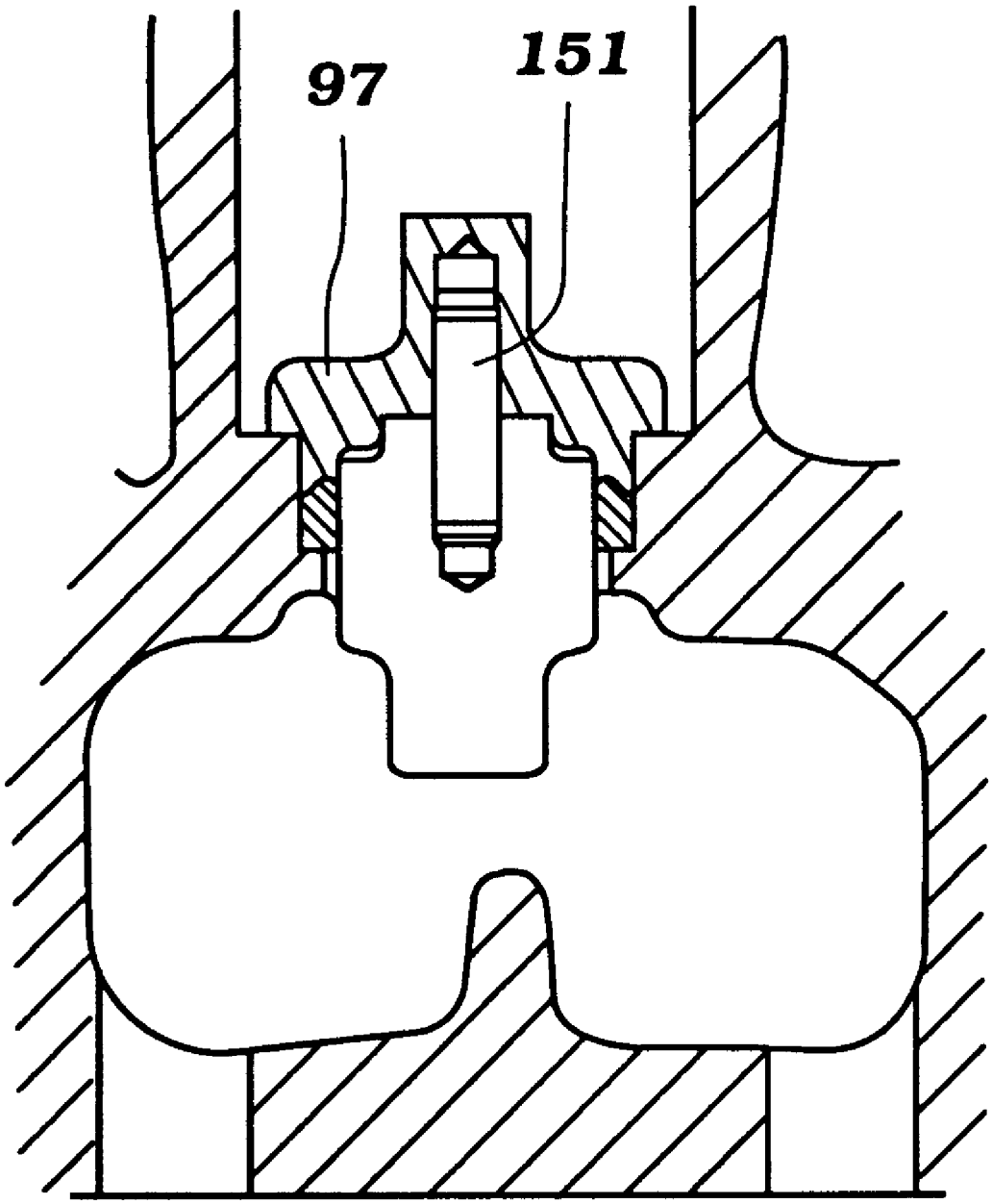
FIG. 13 is a cross-sectional view, in part similar to FIG. 11, and shows another embodiment of the invention.

FIG. 13 shows a slightly different embodiment and one in which the anode element 99 has a tapped opening that is threaded into a stud 151 that is itself threaded into the mounting member 97.

Figure 14:
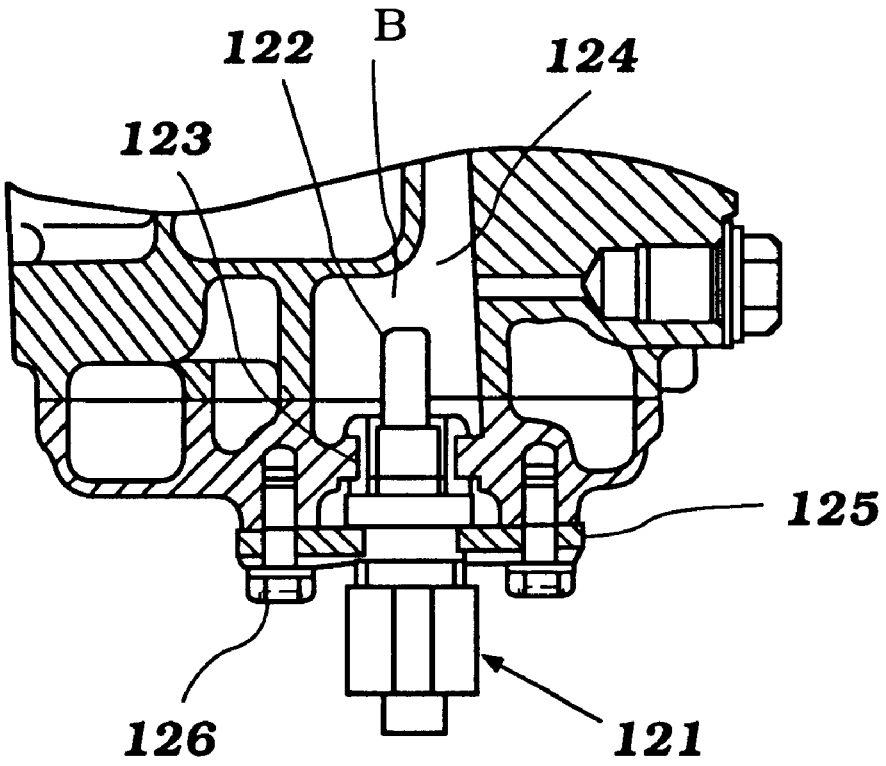
FIG. 14 is an enlarged cross-sectional view of the temperature sensor as shown in FIG. 10.

A thermostatic temperature sensing element, indicated generally by the reference numeral 121 and which appears in FIGS. 2, 7 and 14, is mounted in the cover plate 88 which closes the cooling jackets formed in the cylinder block, as aforenoted. As may be seen in FIGS. 7 and 9, this temperature sensing element is positioned at the outlet side of the exhaust manifold cooling jacket portion B and thus, it will not see the cold water which is first admitted into this cooling jacket nor will it see the extremely highly heated water that is discharged from the discharge conduit 89 at the end of the circuit.

As a result, this temperature sensing element 121 will have a temperature that is more closely related to average actual engine temperature and not either of the extremes. This will ensure long life. Also because of the low mounting position the likelihood of overheating and damage when the engine is stopped and the water may drain from the cooling jackets is also minimized.

Figure 15:
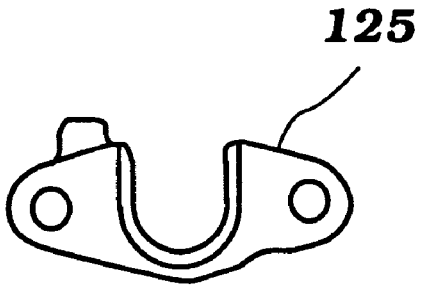
FIG. 15 is a view showing the mounting bracket for the temperature sensor.

As may be seen in FIGS. 14 and 15, the sensing element 121 has a probe portion 122 that extends through a sealing ring 123 and into a cavity 124 formed at the terminal end of the cooling jacket portion B. A retainer plate 125 having a configuration as shown in FIG. 15 is held in place by threaded fasteners 126 for ease of servicing, should that become necessary.

Thus, from the foregoing description, it should be readily apparent that the described cooling system is very effective in providing corrosion protection for the entire cooling system including the highly vulnerable exhaust manifold cooling jacket portion. In addition, the mounting and positioning for the temperature sensor is such that it will be protected from damage but will nevertheless provide a good indication of actual temperature.

Of course, the foregoing description is that of a preferred embodiment of the invention. Various and modifications may be made without departing from the spirit and scope of the invention, as defined by the appended claims.

What is claimed is:

1. An outboard motor powered by a water-cooled internal combustion engine, said outboard motor including a power head in which said engine is contained and which is surrounded by a protective cowling, a drive shaft housing and lower unit depending from said power head and contain a propulsion device for propelling an associated watercraft through a transmission for driving said propulsion device from said engine, said engine being provided with an exhaust system by which the exhaust gases are discharged from said engine to the atmosphere at least in part through said drive shaft housing and lower unit, said engine and said exhaust system being provided with a cooling system that includes an engine cooling jacket portion which extends around the body of said engine and an exhaust cooling jacket portion which extends around a portion of said exhaust system so both said engine body and said exhaust system will be cooled, means for circulating water through said cooling jacket portions the body of water in which the watercraft is operated and for discharging the water back to the body of water at least in part along with the exhaust gases, a first sacrificial anode positioned in said exhaust system cooling jacket for protecting it from corrosion, and at least one second anode positioned in said engine cooling jacket for protecting it from corrosion.

2. An outboard motor as set forth in claim 1 wherein the engine body is comprised of a cylinder block and a cylinder head.

3. An outboard motor as set forth in claim 2 wherein the exhaust system passes at least in part through the engine body.

4. An outboard motor as set forth in claim 3 wherein the engine operates on a four-cycle principle and the cylinder head has exhaust passages that communicate with the combustion chambers and which exhaust passages form a portion of the exhaust system.

5. An outboard motor as set forth in claim 4 wherein the water is first delivered to a cylinder head exhaust cooling jacket that is formed in the cylinder head in proximity to the exhaust passages.

6. An outboard motor as set forth in claim 5 wherein the exhaust system also has a portion that communicates with the cylinder head exhaust passages and which is formed in the cylinder block.

7. An outboard motor as set forth in claim 6 wherein the water from the cylinder head exhaust cooling jacket is returned to a cylinder block exhaust cooling jacket formed in the cylinder block in proximity to the portion of the exhaust system formed therein for cooling this portion of said exhaust system.

8. An outboard motor as set forth in claim 7 wherein water is returned from the cylinder block exhaust cooling jacket to an engine cooling jacket formed in the cylinder block and the cylinder head and which are spaced from the cylinder head and the cylinder block exhaust cooling jackets.

9. An outboard motor as set forth in claim 8 wherein the first sacrificial anode is placed in the cylinder block at the point where the cooling water enters the cylinder block.

10. An outboard motor as set forth in claim 8 wherein the at least one second anode is positioned in the cylinder head cooling jacket.

11. An outboard motor as set forth in claim 10 wherein the cylinder head cooling jacket where the at least one second anode is positioned is a portion of the engine cooling jacket that is not disposed contiguous to the cylinder head exhaust passage.

12. An outboard motor as set forth in claim 11 wherein there are two second anodes positioned in the cylinder head cooling jacket.

13. An outboard motor as set forth in claim 5 wherein the water is first delivered to the engine through the cylinder block.

14. An outboard motor as set forth in claim 13 wherein the first sacrificial anode is placed in the cylinder block at the point where the cooling water enters the cylinder block.

15. An outboard motor as set forth in claim 14 wherein the at least one second anode is positioned in the cylinder head cooling jacket.

16. An outboard motor as set forth in claim 15 wherein the cylinder head cooling jacket where the at least one second anode is positioned is a portion of the engine cooling jacket that is not disposed contiguous to the cylinder head exhaust passage.

17. An outboard motor as set forth in claim 16 wherein there are two second anodes positioned in the cylinder head cooling jacket.

18. An outboard motor as set forth in claim 1 further including a temperature sensor positioned at a low point in the cooling jacket for protecting against overheating of the sensor when the engine is stopped.

19. An outboard motor as set forth in claim 18 wherein the temperature sensor is positioned in a discharge end of the exhaust cooling jacket and upstream of the engine body cooling jacket so as to sense a temperature that is indicative of engine operating temperature but not at a point where the water has completely passed through said cooling jackets and is being discharged back to the body of water in which the watercraft is operating.

20. An outboard motor powered by a water-cooled internal combustion engine, said outboard motor including a power head in which said engine is contained and which is surrounded by a protective cowling, a drive shaft housing and lower unit depending from said power head and contain a propulsion device for propelling an associated watercraft through a transmission for driving said propulsion device from said engine, said engine being provided with an exhaust system by which the exhaust gases are discharged from said engine to the atmosphere at least in part through said drive shaft housing and lower unit, said engine and said exhaust system being provided with a cooling system that includes an engine cooling jacket portion which extends around the body of said engine and an exhaust cooling jacket portion which extends around a portion of said exhaust system so both said engine body and said exhaust system will be cooled, means for circulating water through said cooling jacket portions the body of water in which the watercraft is operated and for discharging the water back to the body of water at least in part along with the exhaust gases, and a temperature sensor positioned at a low point in one of said cooling jackets for protecting against overheating of the sensor when the engine is stopped.

21. An outboard motor as set forth in claim 20 wherein the temperature sensor is positioned in a discharge end of the exhaust cooling jacket and upstream of the engine body cooling jacket so as to sense a temperature that is indicative of engine operating temperature but not at a point where the water has completely passed through said cooling jackets and is being discharged back to the body of water in which the watercraft is operating.

* * * * *